US005964629A

United States Patent [19]

Park et al.

[11] Patent Number: 5,964,629

[45] Date of Patent: Oct. 12, 1999

[54] METHOD OF FABRICATING A FIELD EMISSION DISPLAY DEVICE HAVING A SILICON TIP

[75] Inventors: Jong Moon Park; Jin Keon Ku; Ki Hong Kim; Yeong Cheol Hyeon; Min Park, all of Taejon-Shi, Rep. of Korea

[73] Assignee: Electronics and Telecommunications Research Institute, Daejon, Rep. of Korea

[21] Appl. No.: 08/754,804

[22] Filed: Nov. 21, 1996

[30] Foreign Application Priority Data

Nov. 21, 1997 [KR] Rep. of Korea ..... 95-42597

[51] Int. Cl.[6] ..... H01J 9/02

[52] U.S. Cl. ..... 445/24; 445/50

[58] Field of Search ..... 445/24, 50

[56] References Cited

U.S. PATENT DOCUMENTS 5,316,511 5/1994 Lee ..... 445/24

5,643,032 7/1997 Cheng et al. ..... 445/24

*Primary Examiner*—Kenneth J. Ramsey

*Attorney, Agent, or Firm*—Antonelli, Terry, Stout & Kraus, LLP

[57] ABSTRACT

To form a silicon tip having an undercut, a photoresist pattern having a vertical profile or a positive profile is formed on a silicon substrate and an under-cuted isotropic etching process is then performed using the photoresist pattern as a mask. First and second insulation films are formed on the silicon tip and the silicon substrate except for the silicon tip. The first insulation film is then separated from the second insulation film.

7 Claims, 7 Drawing Sheets

FIG. 4

CONDITIONS OF DRY ETCHING PROCESS IN SILICON

| Step \ Para. | RF power | Pressure | Gas | | Si etch rate (nm / min) | Etcher |
|---|---|---|---|---|---|---|
| | | | $SF_6$ | $O_2$ | | |
| # 1 | 200 W | 200 mtorr | 50 sccm | 15 sccm | 390 | QUAD 484 RIE type |
| # 2 | 200 W | 200 mtorr | 25 sccm | ---- | 270 | |

METHOD OF FABRICATING A FIELD EMISSION DISPLAY DEVICE HAVING A SILICON TIP

BACKGROUND OF THE INVENTION

FIELD OF THE INVENTION

This invention relates to a method of fabricating a field emission display (FED) device having a silicon tip, and more particularly to a method of fabricating a FED device which can reduce manufacturing process and increase the electron emission efficiency of a silicon tip which is formed by etching a silicon substrate using a photoresist pattern as an mask.

In the application field of vacuum microelectronics, it is noted that a flat display is currently being actively studied. A field emission display device has a silicon tip or a metal tip.

A conventional FED having a silicon tip will be explained with reference to FIGS. 1A through 1I. As shown in FIG. 1A, a thermal oxide (or nitride) film 2 is formed on a silicon substrate 1. A photoresist pattern 3 is formed on the thermal oxide film 2, as shown in FIG. 1B. Referring to FIG. 1C, the thermal oxide film 2 exposed to the photoresist pattern 3 is etched and the photoresist pattern 3 is then removed, as shown in FIG. 1D. In the next process, as shown in FIG. 1E, an anisotropic etching process is performed to etch the silicon substrate 1 using the thermal oxide film 2 as a mask. Referring to FIG. 1F, an insulation layer 4 such as an oxide film of which stepcoverage is poor, for example an electron beam deposition oxide film, is formed on the thermal oxide film 2 and the silicon substrate 1. A thermal oxidation process is performed to form a sharp silicon tip, whereby a second thermal oxide film 6 is formed on the surface of the silicon substrate, as shown in FIG. 1G. By performing the thermal oxidation process, the second thermal oxide film 6 is formed with the ratio of $Si:SiO_2$=45:55. A metal deposition process is performed so that a gate metal layer 5 is formed on the oxide film 4, as shown in FIG. 1H. The wet etching process is performed to form a silicon tip 7, as shown in FIG. 1I.

As described above, since the conventional method has a plurality of fabrication steps, manufacturing costs become high. Also, there is a problem in that the electron emission efficiency is decreased and the properties of the device lowered since the gap between the silicon tip 7 and the gate metal layer 5 is wide.

SUMMARY OF THE INVENTION

Therefore, it is an object of the invention to provide a method of fabricating a field emission display device which can solve the above problems.

In accordance with the present invention, the gap between the silicon tip and the gate metal layer is decreased, thereby improving the electron emission efficiency.

To accomplish the above object, a method of fabricating a field emission display device according to the present invention comprises the steps of: forming a photoresist pattern on a selected portion of a silicon substrate; performing a first etching process using the photoresist pattern as a mask so that a silicon tip having an undercut is formed; removing the photoresist pattern, thereby forming a silicon tip; depositing an insulation film so that a first insulation film is formed on the silicon tip and a second insulation film is formed on the silicon substrate except for the silicon tip, wherein the first insulation film is separated from the second insulation film; performing a thermal oxidation process to form a thermal oxide film on the silicon tip; forming a metal layer on the first and second insulation film; and performing a second etching process to remove the thermal oxide film, the first insulation film, the metal layer formed on the first insulation film, and a portion of the second insulation film overlying the silicon substrate, thereby forming a sharp silicon tip.

BRIEF DESCRIPTION OF THE DRAWINGS

For fuller understanding of the nature and objects of the invention, reference should be had to the following detailed description taken in conjunction with the accompanying drawings in which:

FIG. 4 presents the conditions for dry etching which can be applied to the step of FIG. 2B.

Similar reference characters refer to similar parts in the several views of the drawings.

DETAILED DESCRIPTION OF THE INVENTION

Figure 1A:
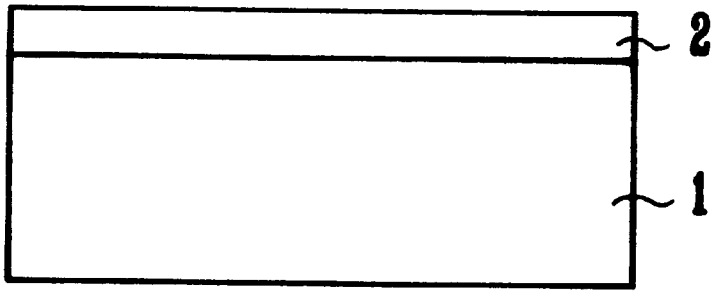
FIG. 1A (PRIOR ART)
FIGS. 1A through 1I are sectional views for explaining a conventional method of fabricating a FED.
Figure 1B:
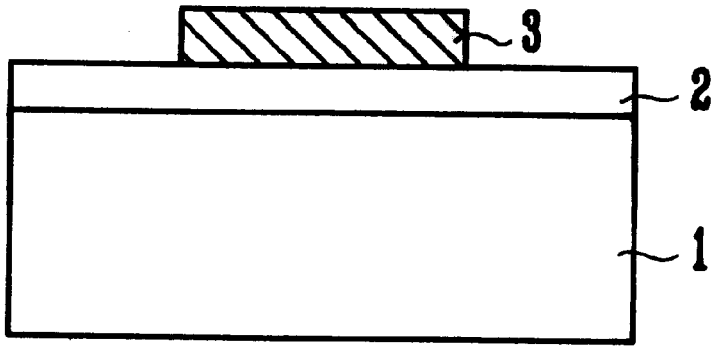
FIG. 1B (PRIOR ART)
Figure 1C:
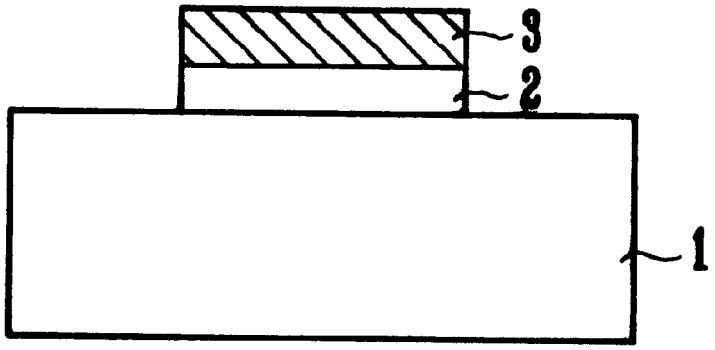
FIG. 1C (PRIOR ART)
Figure 1D:
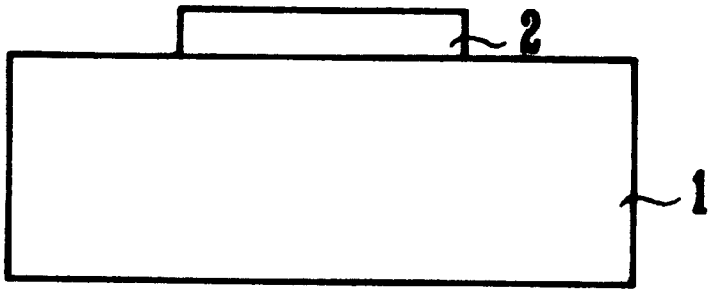
FIG. 1D (PRIOR ART)
Figure 1E:
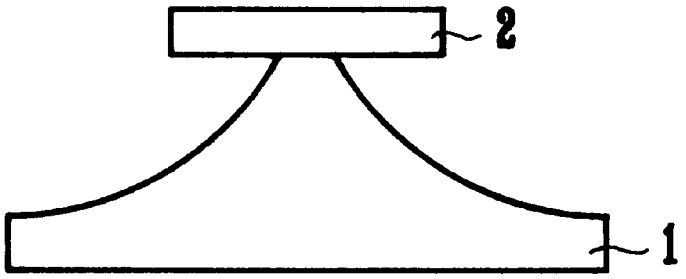
FIG. 1E (PRIOR ART)
Figure 1F:
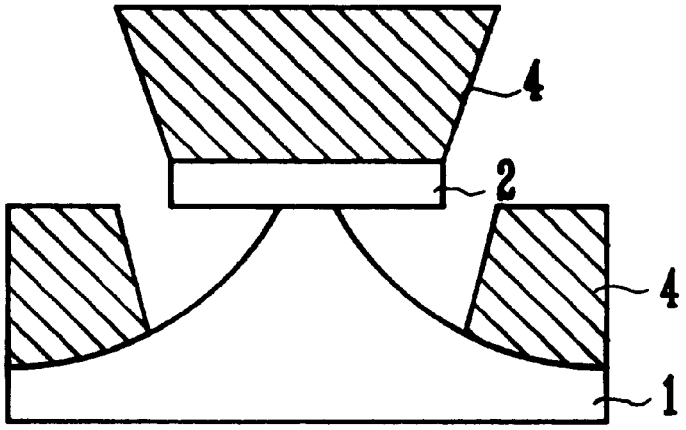
FIG. 1F (PRIOR ART)
Figure 1G:
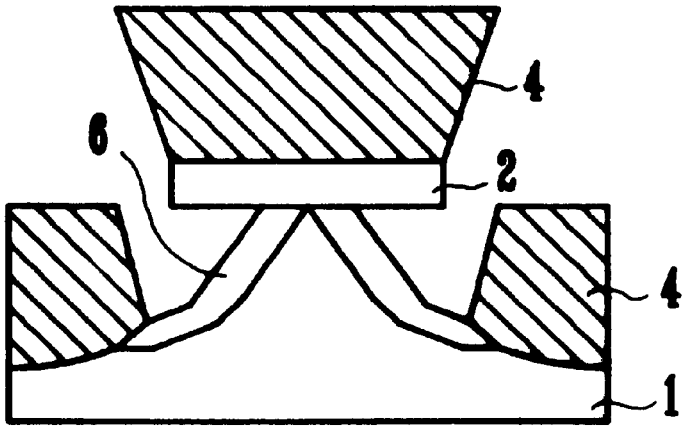
FIG. 1G (PRIOR ART)
Figure 1H:
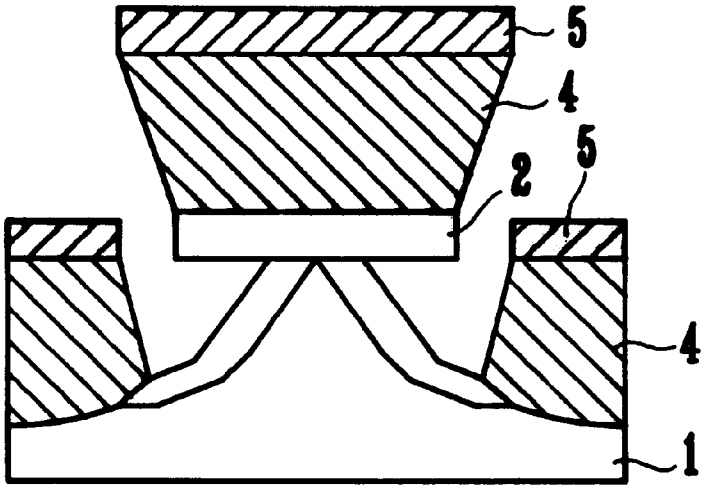
FIG. 1H (PRIOR ART)
Figure 1I:
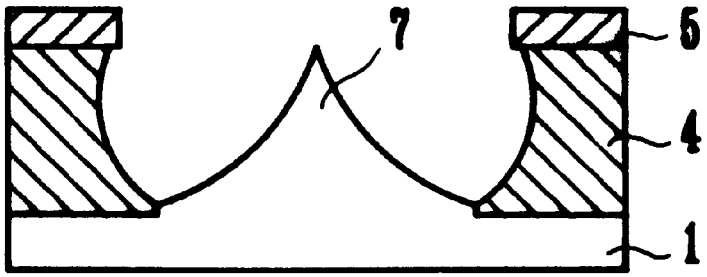
FIG. 1I (PRIOR ART)
Figure 2A:
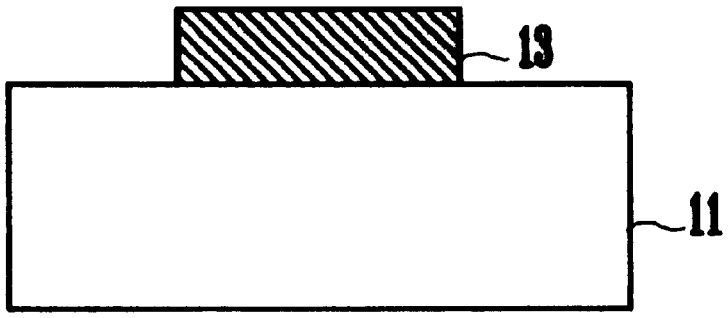
FIGS. 2A through 2G are sectional views for explaining a method of fabricating a FED according to the present invention.
Figure 2B:
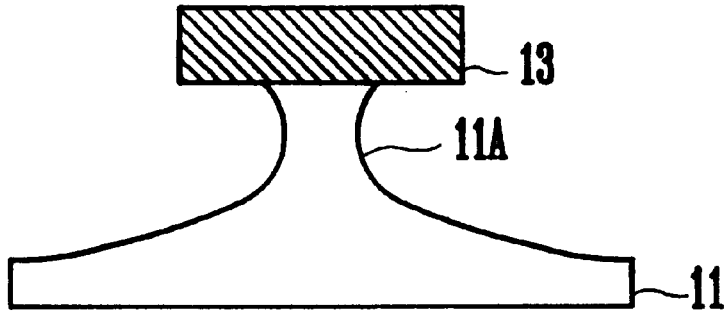
Figure 3A:
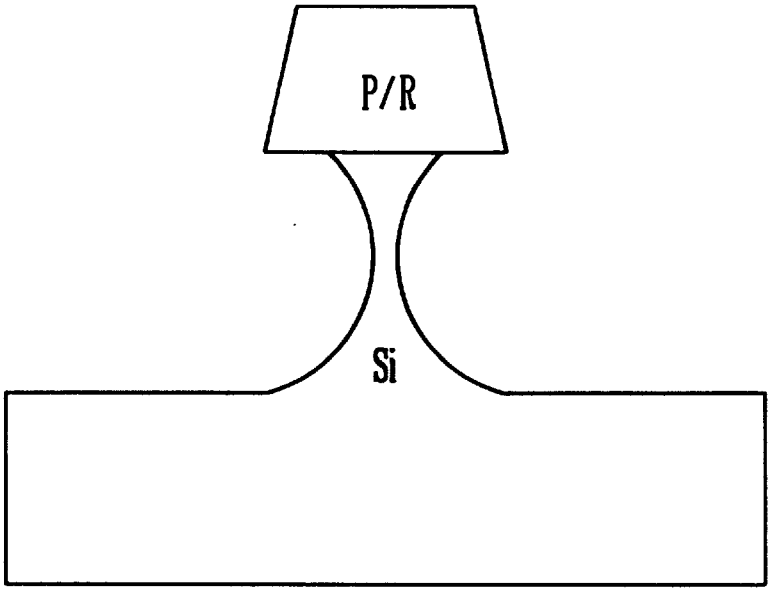
FIGS. 3A and 3B are views for explaining FIGS. 2B and 2D, respectively.

In the present invention, the formation of a thermal oxide film as shown in FIG. 1 is not required. That is, a photoresist is coated onto a silicon substrate 11 and the photoresist is then patterned to have a vertical profile or a tilt profile, whereby a photoresist pattern 13 is formed on the silicon substrate 11 (FIG. 2A). Isotropic etching processes (see FIG. 4) are performed using the photoresist pattern 13 as a mask so that the silicon tip 11A having an undercut is formed, as shown in FIG. 2B and FIG. 3A. Illustratively, in the above-described processes, as shown in FIG. 4, the reaction is performed using parameters, such as an RF power of 200 W, a pressure of 200 mtorr, Si etch rate of 390 nm/min, and etcher of QUAD 484, under the atmosphere including 50 sccm of $SF_6$ and 15 sccm of $O_2$ in step 1, and after a predetermined period from step 1, an RF power of 200 W, a pressure of 200 mtorr, Si etch rate of 270 nm/min, and etcher of RIE type, under the atmosphere including 25 sccm of $SF_6$ in step 2.

Figure 2C:
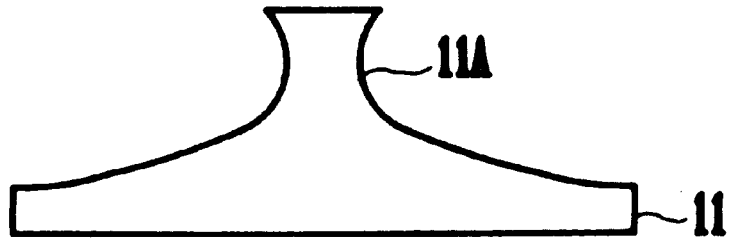
Figure 2D:
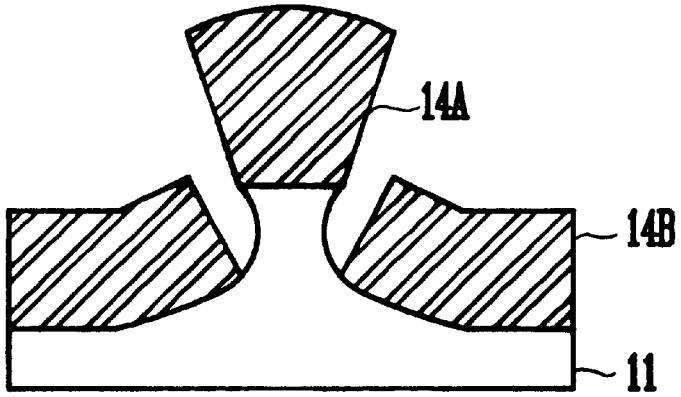
Figure 2E:
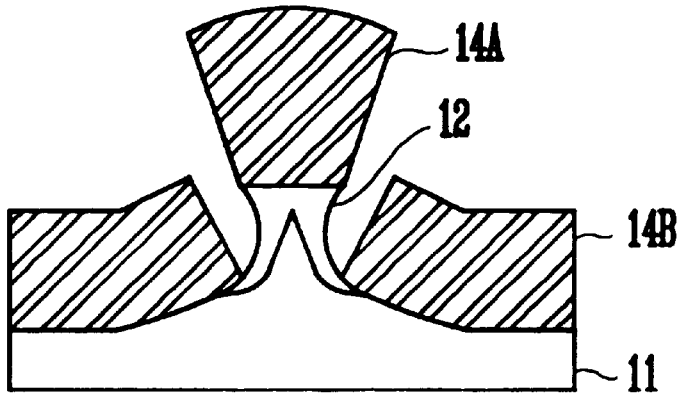
Figure 3B:
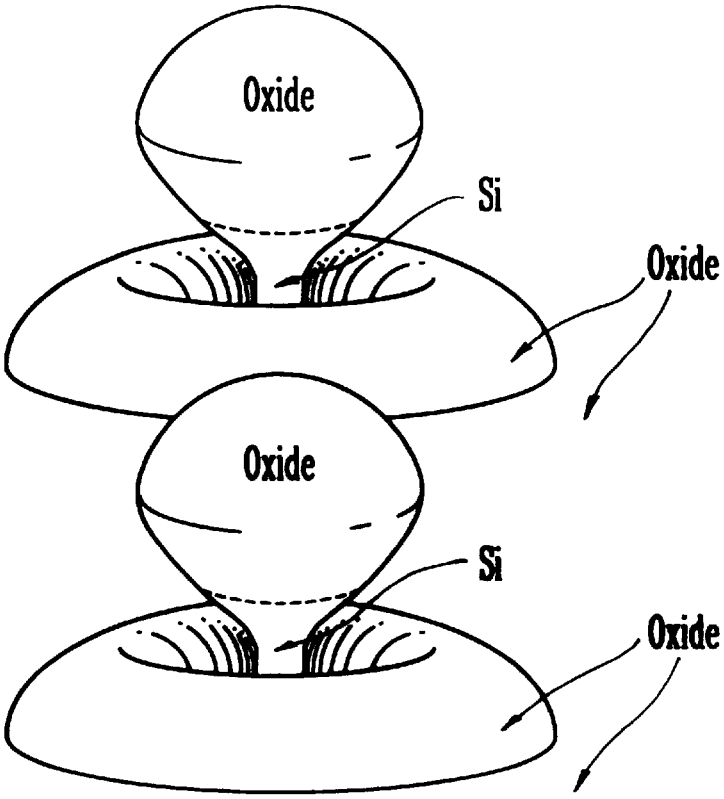

After the process of FIG. 2B, the photoresist pattern 13 is removed (FIG. 2C) and a gate insulation film, such as an oxide film, of which stepcoverage is poor, is then deposited on the resulting structure after removing the photoresist film 13 by a deposition process using an electron beam, as shown in FIG. 2D and FIG. 3B. In this process, the gate insulation film is not formed in the undercut. As a result, a first oxide film 14A is formed over the silicon tip 11A and a second oxide film 14B is formed on a portion except for the silicon tip 11A, wherein the first oxide film is separated from the second oxide film 14B. To sharpen the silicon tip 11A, thermal oxidation process is performed so that a thermal oxide 12 is formed, as shown in FIG. 2E. By performing the thermal oxidation, the thermal oxide 12 is formed with the ratio of $Si:SiO_2$=45:55.

Figure 2F:
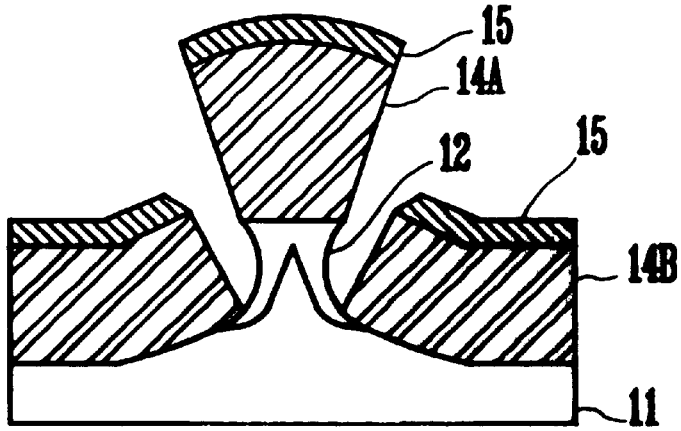
Figure 2G:
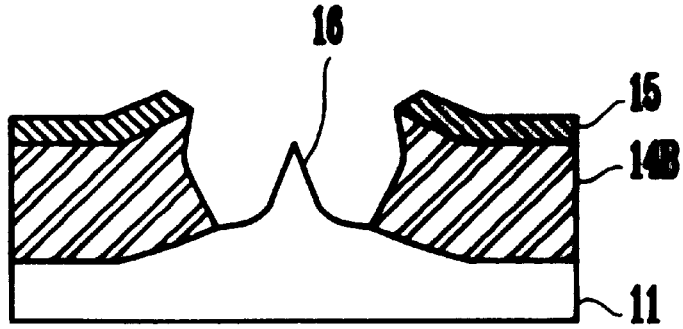

A gate metal layer 15, such as Mo or TiW is deposited on the first and second oxide films 14A and 14B (FIG. 2F) and a wet etching process is then performed so that the thermal oxide 12, the gate metal layer 15, formed on the first oxide film 14A and the oxide film 14A is removed as well as a portion of the second oxide film 14B overlying the silicon substrate 11 is removed, thereby forming a sharp silicon tip 16, as shown in FIG. 2G.

The undercut formed by the process of FIG. 2B plays a very important role in the separation of the first oxide film 14A deposited on the silicon tip 11A and the second oxide film 14B deposited on a portion except for the silicon tip 11A.

As described above, a method of fabricating a FED according to the present invention is simpler than a conventional method, whereby the manufacturing cost is reduced and fever defects occur during the manufacturing of the FED is reduced. As a result, product yield is increased. Furthermore, the gap between the silicon tip and the gate metal layer is reduced since the first and second oxide film are formed without a mask. Accordingly, the electron emission efficiency of the silicon tip is increased, thereby improving the properties of the FED.

The foregoing description, although described in its preferred embodiment with a certain degree of particularity, is only illustrative of the principles of the present invention. It is to be understood that the present invention is not to be limited to the preferred embodiments disclosed and illustrated herein. Accordingly, all expedient variations that may be made within the scope and spirit of the present invention are to be encompassed as further embodiments of the present invention.

What is claimed is:

1. A method of fabricating a field emission display device, comprising the steps of:

forming a photoresist pattern on a selected portion of a silicon substrate;

performing a first etching process using said photoresist pattern as a mask to form a silicon tip having an undercut;

removing said photoresist pattern, thereby forming a silicon tip;

depositing an insulation film so that a first insulation film is formed on said silicon tip and a second insulation film is formed on said silicon substrate except for said silicon tip, wherein said first insulation film is separated from said second insulation film;

performing a thermal oxidation process to form a thermal oxide film on said silicon tip;

forming a metal layer on said first and second insulation film; and performing a second etching process to remove said thermal oxide film, said first insulation film and said metal layer formed on said first insulation film, and a portion of said second insulation film overlying said silicon substrate, thereby forming a sharp silicon tip.

2. The method of claim 1, wherein said photoresist pattern has a vertical profile.

3. The method of claim 1, wherein said photoresist pattern has a positive profile.

4. The method of claim 1, wherein said first etching process is an isotropic etching process.

5. The method of claim 1, wherein said first and second insulation films are formed and are separated by a deposition process using an electron beam.

6. The method of claim 1, wherein said second etching process is a wet etching process.

7. The method of claim 1, wherein said first and second insulation films are formed of an oxide film of which stepcoverage is poor.

* * * * *